US011460240B2

(12) United States Patent
Yu et al.

(10) Patent No.: US 11,460,240 B2
(45) Date of Patent: Oct. 4, 2022

(54) REFRIGERATOR

(71) Applicant: LG ELECTRONICS INC., Seoul (KR)

(72) Inventors: Seonil Yu, Seoul (KR); Daesung Lee, Seoul (KR); Hyun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 280 days.

(21) Appl. No.: 16/682,902

(22) Filed: Nov. 13, 2019

(65) Prior Publication Data

US 2020/0217582 A1 Jul. 9, 2020

(30) Foreign Application Priority Data

Jan. 4, 2019 (KR) ..... 10-2019-0001222

(51) Int. Cl.
*F25D 25/02* (2006.01)
*F25D 11/02* (2006.01)

(52) U.S. Cl.
CPC ..... *F25D 25/025* (2013.01); *F25D 11/02* (2013.01); *F25D 25/027* (2013.01); *F25D 2325/021* (2013.01); *F25D 2500/06* (2013.01)

(58) Field of Classification Search
CPC ..... F25D 25/025; F25D 25/027; F25D 25/04; F25D 25/024; F25D 25/005; F25D 11/02; F25D 2325/021; F25D 2500/06; A47B 51/00; A47B 46/005; A47B 95/00; A47B 96/025
See application file for complete search history.

(56) References Cited

U.S. PATENT DOCUMENTS 2,843,441 A * 7/1958 Jewell ..... F25D 25/025 312/334.47
2,926,507 A * 3/1960 Ingolia ..... F25D 23/02 312/274
2,975,012 A * 3/1961 Thull ..... F25D 25/025 312/274
3,195,969 A * 7/1965 Wallen ..... A47L 15/506 312/273
3,195,970 A * 7/1965 Chuboff ..... F25D 25/025 312/334.44
7,232,196 B2 * 6/2007 Kwon ..... A47B 46/005 312/402

(Continued)

FOREIGN PATENT DOCUMENTS

CN 1656349 A 8/2005
CN 106382787 A 2/2017

(Continued)

*Primary Examiner* — Emmanuel E Duke
(74) *Attorney, Agent, or Firm* — Dentons US LLP

(57) ABSTRACT

A refrigerator having a first storage compartment with a first storage space and a movable shelf assembly disposed in the first storage space, wherein the movable shelf assembly includes a movable shelf movably disposed in the first storage space, a plurality of links, one end of each of the links being pivotably coupled to each of both sides of the movable shelf, and a driver coupled to the other end of each of the links such that each link pivots, wherein the driver is configured to move each link forwardly and outwardly of the first storage space and, at the same time, to pivot each link.

12 Claims, 12 Drawing Sheets

(56) References Cited

U.S. PATENT DOCUMENTS

| | | | | |
|---|---|---|---|---|
| 7,621,605 | B2 * | 11/2009 | Bond | A47B 46/005 312/325 |
| 9,803,916 | B2 | 10/2017 | Park et al. | |
| 2008/0129168 | A1 * | 6/2008 | Banta | A47L 15/506 134/135 |
| 2009/0193836 | A1 * | 8/2009 | Ertz | F25D 25/025 62/449 |
| 2010/0283368 | A1 * | 11/2010 | Lee | F25D 23/04 312/405.1 |
| 2014/0125212 | A1 * | 5/2014 | Choo | F25D 25/025 312/405.1 |
| 2014/0239789 | A1 * | 8/2014 | Rehage | A47B 88/70 312/334.1 |
| 2015/0054395 | A1 * | 2/2015 | Arslankiray | F25C 5/22 312/404 |

FOREIGN PATENT DOCUMENTS

| | | | |
|---|---|---|---|
| CN | 107606842 | A | 1/2018 |
| JP | 08-303914 | A | 11/1996 |
| JP | 2003-322465 | A | 11/2003 |
| KR | 10-2010-0032178 | A | 3/2010 |
| KR | 1020110037553 | A | 4/2011 |

* cited by examiner

REFRIGERATOR

CROSS-REFERENCE TO RELATED APPLICATION

This application claims the benefit of Korean Patent Application No. 10-2019-0001222, filed on Jan. 4, 2019, with the Korean Intellectual Property Office, the entire content of which is incorporated herein by reference.

BACKGROUND

1. Field

The present disclosure relates to a refrigerator, and more particularly to a refrigerator having a movable shelf.

2. Description of Related Art

A refrigerator is an apparatus for freezing or refrigerating and storing food and the like by maintaining a temperature of a storage compartment disposed in the refrigerator at a predetermined temperature using a freezing cycle composed of a compressor, a condenser, an expansion valve, and an evaporator. In general, the refrigerator includes a freezing compartment for freezing and storing food or beverages and a refrigerating compartment for storing the food or beverages at low temperatures.

Refrigerators are distinguished based on locations of the freezing compartment and the refrigerating compartment. For example, the refrigerators may be divided into a top mount type with the freezing compartment located above the refrigerating compartment, a bottom freezer type with the freezing compartment located below the refrigerating compartment, and a side by side type with the freezing compartment and refrigerating compartment divided left and right by a partition.

Recently, due to consumer demand, temperatures of the refrigerating compartment and the freezing compartment are able to be freely adjusted based on the food stored in the refrigerator. Refrigerators that allows uses of a larger refrigerating compartment by allowing the freezing compartment to have the same temperature as the refrigerating compartment have been proposed and used.

A food storage location may vary depending on a type, processing and packaging conditions of the food. The refrigerating compartment and the freezing compartment may have separate shelves, drawers, baskets, and the like arranged therein for storing food.

Various food to be stored in a refrigerated manner or a frozen manner may be properly stored in a shelf, drawer, basket, etc. in the refrigerating compartment and freezing compartment of the refrigerator. The drawers, shelves and baskets may be arranged in a various manner in the storage spaces in the refrigerating compartment and freezing compartment, to accommodate food of varying sizes and storage conditions.

A plurality of shelves may be arranged in a vertical direction in a storage space of a conventional refrigerator. An upper shelf is generally located eye level of an average height user.

Thus, when the user intends to withdraw and place food from and on the upper shelf, there is a problem that withdrawal and the placement of the food is inconvenient due to the height of the shelf.

In addition, there is a problem that it is more difficult for a short height user to check or store and withdraw the food stored in the upper shelf in the storage space.

Accordingly, the upper shelf located in an upper level of the storage space is used less frequently than other storage spaces of the refrigerator, which reduces the storage space use efficiency of the refrigerator.

SUMMARY

The present disclosure is solves at least the above-mentioned problems.

One purpose of the present disclosure is to provide a refrigerator that is more convenient for a user by improving the structure of a shelf of the refrigerator.

Another purpose of the present disclosure is to provide a refrigerator in which a shelf structure is improved to change a vertical level of the shelf at which the user stores or withdraw food on or from the shelf such that the user may easily store and withdraw food on or from the shelf.

Another purpose of the present disclosure is to provide a refrigerator in which a shelf structure is improved to change a vertical level of the shelf at which the user stores or withdraw food on or from the shelf to improve the use efficiency of the refrigerator storage space.

It is understood that the purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

One object of the present disclosure proposes a refrigerator comprising: a first storage compartment having a first storage space defined therein; a fixed shelf detachably disposed in the first storage space, wherein food or a food container is loaded on the fixed shelf; and a movable shelf assembly disposed in the first storage space, wherein the movable shelf assembly is configured to forwardly extend outwardly of the first storage space, wherein the movable shelf assembly includes: a movable shelf movably disposed in the first storage space; a plurality of links, one end of each of the links being pivotably coupled to each of both sides of the movable shelf; and a driver coupled to the other end of each of the links such that each link pivots, wherein the driver is configured to move each link forwardly and outwardly of the first storage space and, at the same time, to pivot each link.

In one embodiment, the plurality of links includes at least two links allowing the movable shelf to pivot while a horizontal orientation of the shelf is maintained, wherein at least one of the at least two links is driven by the driver.

In one embodiment, the movable shelf includes: a body for receiving food or a food container thereon; and both supports vertically extending from both sides of the body respectively, wherein the at least two links are pivotally coupled to each support, wherein the at least two links are coupled to different positions of each support.

In one embodiment, the movable shelf assembly further includes a stopper extending between the both supports to prevent the food or container loaded onto the body from falling down from the body.

In one embodiment, each driver is positioned on each of both sides of the first storage compartment, wherein each of the links is pivotally connected to each driver.

In one embodiment, each driver includes: a fixed housing fixed to the first storage compartment; and a movable housing movably disposed in the fixed housing to be moved forwardly and backwardly in the storage space.

In one embodiment, the movable housing has a rack having a predetermined length, wherein the fixed housing has a rotor damper configured to be engaged with the rack to control a speed of movement of the movable housing.

In one embodiment, each driver further includes: a linear and pivoting motion switch disposed in the movable housing, wherein the linear and pivoting motion switch is coupled to and moves together with one of the plurality of links; and a linear and pivoting motion guide disposed in the fixed housing, wherein the linear and pivoting motion guide is configured to guide the movement of the linear and pivoting motion switch.

In one embodiment, the linear and pivoting motion switch has a slidable protrusion protruding from one end thereof toward the linear and pivoting motion guide, wherein the linear and pivoting motion guide has: a first curved slot to guide movement of the slidable protrusion of the linear and pivoting motion switch when the movable shelf moves linearly; and a second curved slot to guide movement of the slidable protrusion when the movable shelf moves pivotally.

In one embodiment, the movable housing further houses an elastic support for pressing and stopping the linear and pivoting motion switch using a predetermined elastic force when the linear and pivoting motion switch moves.

In one embodiment, the refrigerator further comprises a second storage compartment disposed below the first storage compartment and having a second storage space defined therein, the second storage compartment operating independently of the first storage compartment.

In one embodiment, the second storage compartment contains at least one drawer configured to extend from the second storage space to open the second storage space.

Effects of the present disclosure are as follows but are not limited thereto.

According to the refrigerator according to the present disclosure, the refrigerator may meet convenience for the user by improving the structure of the shelf of the refrigerator.

Further, according to the refrigerator according to the present disclosure, the shelf structure of the refrigerator is improved to change a vertical level of the shelf at which the user stores or withdraw food on or from the shelf such that the user may store and withdraw food easily on or from the shelf.

Furthermore, according to the refrigerator according to the present disclosure, the shelf structure of the refrigerator is improved to change a vertical level of the shelf at which the user stores or withdraw food on or from the shelf to improve the use efficiency of the storage space.

BRIEF DESCRIPTION OF THE DRAWINGS

The accompanying drawings constitute a part of this specification and illustrate an embodiment of the present disclosure and together with the specification, explain the present disclosure.

DETAILED DESCRIPTIONS

Figure 1:
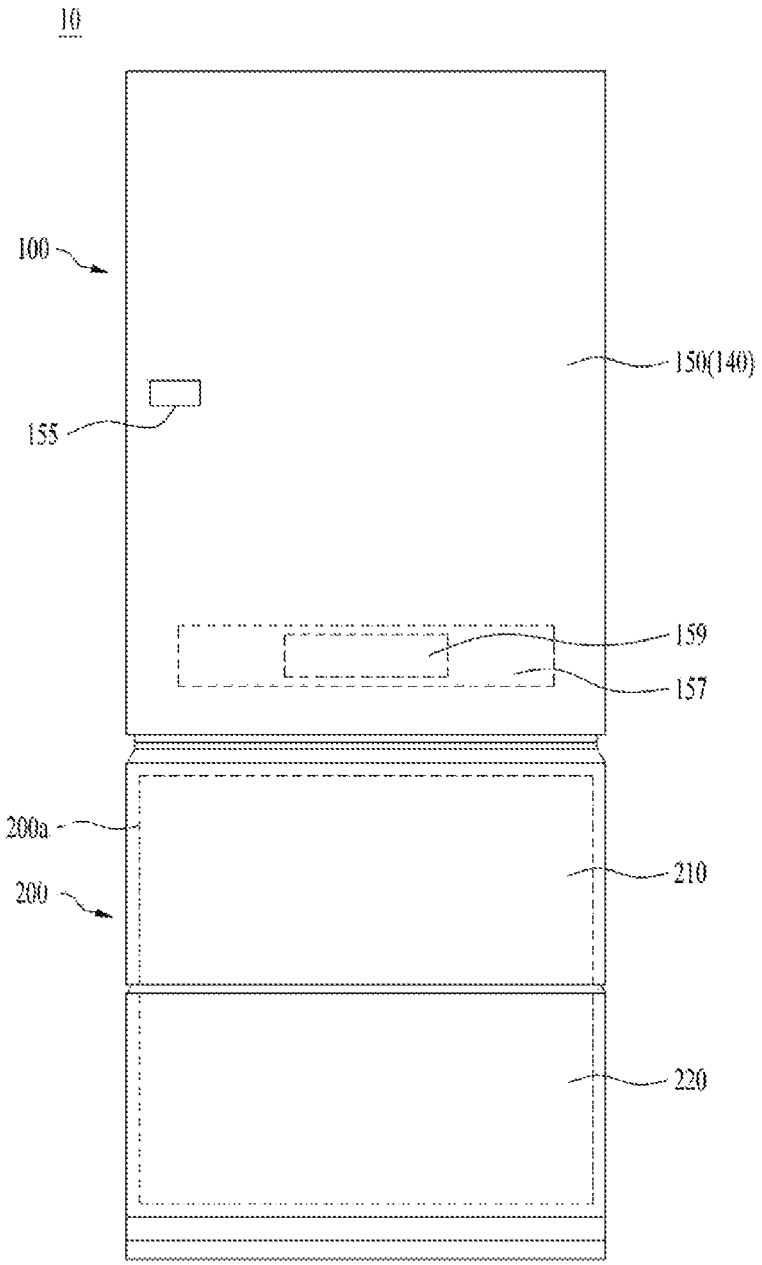
FIG. 1 is a front view of a refrigerator according to an embodiment of the present disclosure.

For simplicity and clarity of illustration, elements in the figures are not necessarily drawn to scale. The same reference numbers in different figures denote the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one" of when preceding a list of elements may modify the entire list of elements and may not modify the individual elements of the list.

In describing the components of the embodiment(s) of the present disclosure, terms such as first, second, A, B, (a), and (b) may be used. These terms are only for distinguishing the components from other components, and the nature, order or order of the components are not limited by the terms. If a component is described as being "connected", "coupled" or "connected" to another component, it should be understood that the component may be directly connected or connected to that other component, but having other components there between.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

First, the refrigerator according to one embodiment of the present disclosure will be described in detail with reference to the accompanying drawings.

Figure 2:
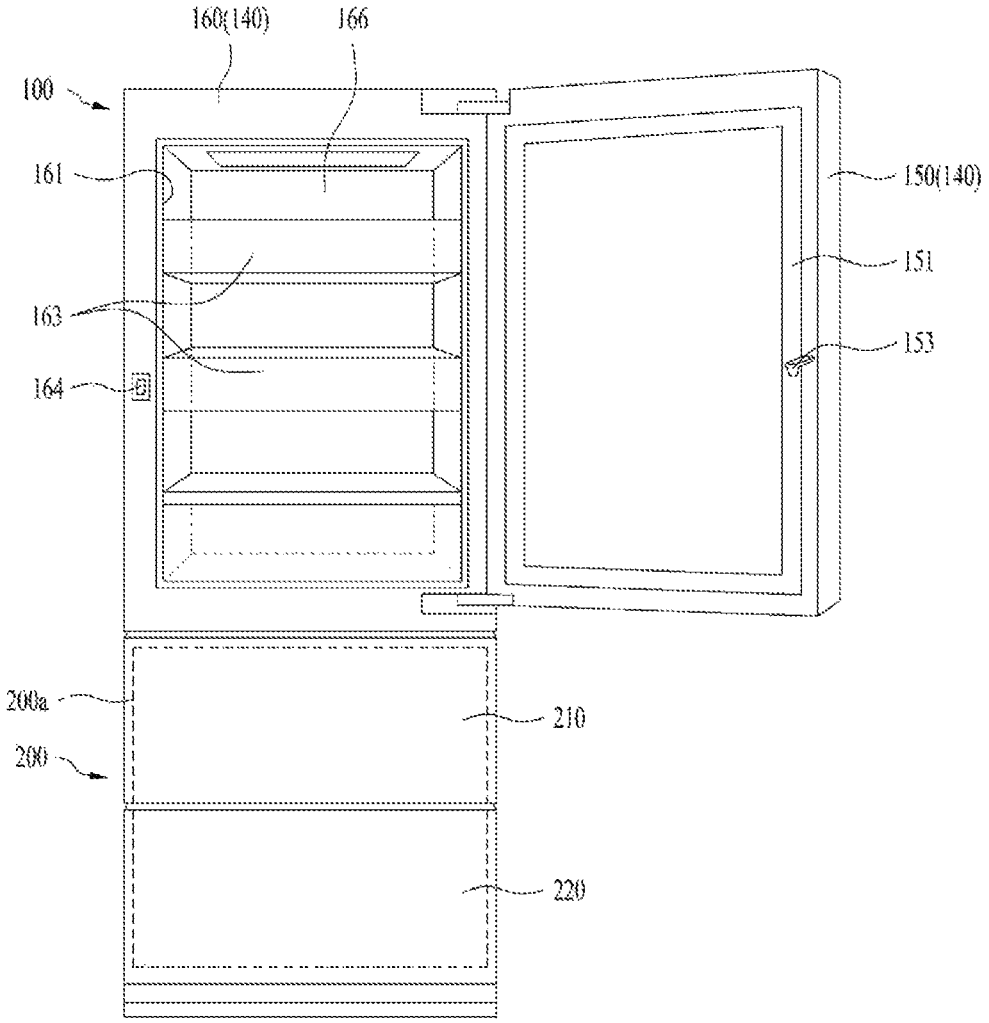
FIG. 2 is a front view illustrating a state in which an outer door of a refrigerator is open according to an embodiment of the present disclosure.

FIG. 1 is a front view of a refrigerator according to an embodiment of the present disclosure. Further, FIG. 2 is a front view illustrating a state in which an outer door of a refrigerator is open according an embodiment of to the present disclosure. Further, FIG. 3 shows a front view illustrating a state in which an inner door of a refrigerator is open according to an embodiment of the present disclosure.

Figure 3:
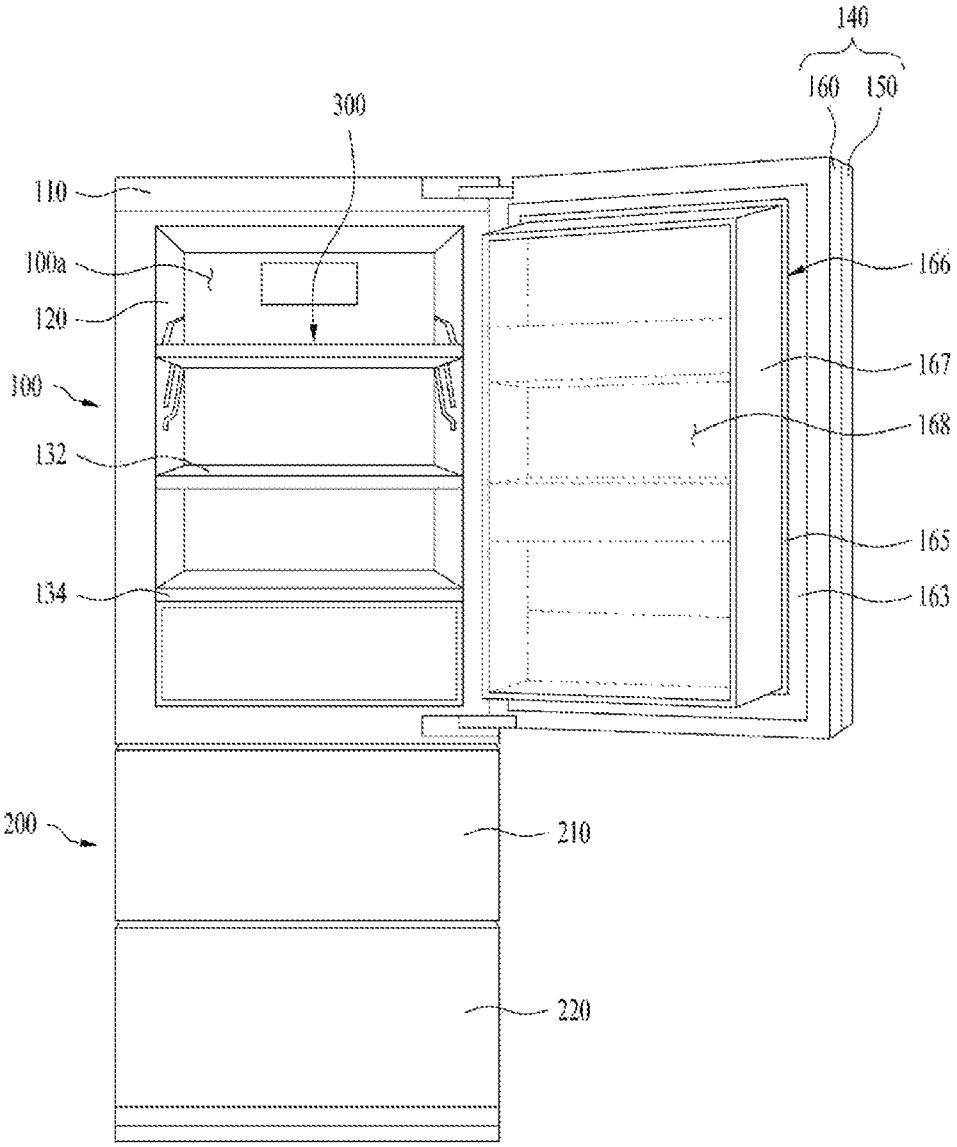
FIG. 3 shows a front view illustrating a state in which an inner door of a refrigerator is open according an embodiment of to the present disclosure.

As shown in FIGS. 1 to 3, a refrigerator 10 may be formed having a substantially rectangular parallelepiped shape with an open front face. The shape is not limited thereto. The refrigerator 10 may include a first storage compartment 100 disposed at an upper portion of the refrigerator 10 to define a first storage space 100*a* therein and a second storage compartment 200 disposed below the first storage compartment 100 to define therein a second storage space 200*a*, which is opened and closed in a form of a drawer. The upper portion of the refrigerator 10 is relative to the ground and above a lower portion of the refrigerator 10.

In this embodiment, the first storage space 100*a* or the second storage space 200*a*, which is a storage space for storing food or other items therein, may be selectively disposed as a refrigerating compartment or a freezing compartment. In the present embodiment, for convenience purposes, it is described that the first storage space 100*a* and the second storage space 200*a* are used as the refrigerating compartments, but they are not limited to the refrigerating compartments.

Depending on a type or a temperature of food or other items to be stored in the first storage space 100*a* or in the second storage space 200*a*, the first storage space 100*a* and the second storage space 200*a* may be selectively used as the refrigerating compartment/freezing compartment or the freezing compartment/refrigerating compartment, respectively. Alternatively, both the first storage space 100*a* and the second storage space 200*a* may be used as the refrigerating compartments or the freezing compartments.

In one example, the first storage space 100*a* may be communicably coupled with a front opening opened forwardly of the refrigerator 10. The first storage space 100*a* may contain a plurality of shelves 132 and 300 for loading thereon food or other items stored in the first storage space 100*a*. In this embodiment, the multiple of shelve 132 and 300 may be detachably disposed to variably adjust a spacing therebetween depending on a type and size of food stored in the first storage space 100*a*.

Further, the plurality of shelves 132 and 300 may be arranged in the vertical direction in the first storage space 100*a*. One or more shelf 300 disposed at a higher position may be configured as a movable shelf 300 which is capable of extending and descending to a position in front of another shelf 132 positioned at a lower position thereof.

The shelves 132 and 300 disposed in the first storage space 100*a* are arranged in the vertical direction of the refrigerator 10. Accordingly, it may be difficult or inconvenient for a user to place or withdraw food or a container on or from the upper shelf 300 positioned at the higher position.

Therefore, at least one upper shelf 300 positioned at a top level or a higher level in the first storage space 100*a* may be configured as a movable shelf 300 (moveable shelf 300) to further improve the user convenience. The movable shelf 300 will be described in detail below with reference to the drawings.

Further, a door 140 for opening and closing the first storage space 100*a* and defining therein a separate door storage space separate from the first storage space 100*a* at the same time is disposed at one side of the opening of the first storage space 100*a*, The door 140 is preferably pivotally attached to one side of the opening of the first storage space 100*a*, such as shown in FIGS. 2 and 3.

In this embodiment, the door 140 may include an inner door 160 for opening and closing the first storage space 100*a* and simultaneously including a home bar space defined therein, which is a separate storage space and an outer door 150 disposed to open and close the storage space of the inner door 160.

Widths and lengths of the outer door 150 and the inner door 160 may be the same. Further, a plurality of door baskets or containers (not shown) may be spaced apart from each other in a vertical direction at a rear face of the outer door 150, that is, a face facing the inner door 160.

An outer door gasket 151 may surround edges on the rear face of the outer door 150. A latch 153 may be disposed at the rear face of the outer door 150 on a side edge thereof, which is opposite to a side of the outer door 150 where a pivot axis is formed. The latch 153 may be disposed at an outer side of the outer door gasket 151.

In one example, a manipulator 157 (controller) for controlling operation states of the first storage compartment 100 and the second storage compartment 200 of the refrigerator 10 and a display 159 for indicating the operating states of the first storage compartment 100 and the second storage compartment 200 may be disposed on an outer face of the outer door 150. The manipulator 157 may include a button-type or touch-type input part. The manipulator 157 may be configured with buttons, a dome-shaped switch, a resistive/capacitive touch pad, a dial (jog wheel), jog switch (jog switch), the finger mouse, rotary switch, dial (jog dial), and other means to produce the input data by a specific operation such as pushing, rotating, pressing and contacting the like. The display 159 may be a light emitter (e.g. a light emitting diode (the LED), liquid crystal display (LCD) or organic electroluminescent (EL) display). The display 159 may receive a variety of manipulation signals for operating the refrigerator and displays information on the operation of the refrigerator to an external side.

In one example, an opening 161 with a predetermined size is provided in a center portion of the inner door 160 and a receiving casing 166 is provided on a rear face of the inner door 160. The opening 161 allows access into the receiving casing 166 in a state in which the inner door 160 is closed and the outer door 150 is opened.

In this embodiment, the outer door gasket 151 surrounded on the rear face of the outer door 150 is in close contact with a front face of the inner door 160 and the opening 161 is enclosed along outer edges of the outer door gasket 151. Therefore, when the outer door 150 is in close contact with the front face of the inner door 160, e.g., when the outer door 150 is closed, a phenomenon in which cold air flows out between the inner door 160 and the outer door 150 is blocked.

In one example, a plurality of door baskets 162 may be mounted or disposed in the opening 161 of the inner door 160. The plurality of door baskets 162 may be spaced apart from each other at predetermined intervals in the vertical direction of the inner door 160.

Further, a door dike 165 may protrude from an edge of the rear face of the inner door 160 and a front end of the receiving casing 166 may be coupled to the door dike 165. An inner door gasket 163 may surround edges on the rear face of the inner door 160, which corresponds to an outer side of the door dike 165.

Therefore, when the inner door 160 is in close contact with a front face of outer casing 110, e.g., when the inner door 160 is closed, the inner door gasket 163 is in close contact with the front face of the outer casing 110 of the first storage compartment 100, so that the cold air inside the first storage space 100*a* is prevented from leaking to the outside.

Further, a lock 164 may be disposed on the front face of the inner door 160, preferably, at a point corresponding to the latch 153 in a state in which the outer door 150 is closed. When the outer door 150 is in close contact with the front face of the inner door 160, the latch 153 is configured to fasten or engage with the lock 164, so that the outer door 150 may be kept closed.

Further, a door switch 155 may be disposed on an upper side (top) or a lower side (bottom) of the front face of the inner door 160. The door switch 155 may be disposed away from the pivot axis of the outer door 150 or may be disposed at a point close to the pivot axis.

The second storage compartment 200 may be located below the first storage compartment 100 and may have one or more drawers 210 and 220 that are configured to extend forward from the refrigerator 10. In a case of the second storage compartment 200, the second storage space 200*a*, where the food is stored therein, may be exposed by the extension of the drawers 210 and 220. Further, the second storage space 200*a* may be divided by the plurality of drawers 210 and 220.

In one example, the second storage compartment 200 may be used as the refrigerating compartment or the freezing compartment independently of the first storage compartment 100. The second storage compartment 200 may have one or more drawers 210 and 220 that open the second storage space 200*a* of the second storage compartment 200 and define spaces for storing the food therein.

In this embodiment, the drawers 210 and 220 may have an upper drawer 210 forming an upper front face of the second storage compartment 200 and a lower drawer 220 forming a lower front face of the second storage compartment 200. The upper and lower front faces of the second storage compartment 200 may form exterior surfaces of the refrigerator visible.

In one example, a refrigerating cycle apparatus (not shown) for adjusting temperatures of the first storage space 100*a* and the second storage space 200*a* may be disposed inside the refrigerator 10, in a separate space separated from the first storage space 100*a* and the second storage space 200*a*.

In this embodiment, for example, the refrigerating cycle apparatus may have a refrigerant cycle composed of a compressor, a condenser, an expander, and an evaporator and a flow path for supplying the cold air into the first storage space 100*a* and the second storage space 200*a*. The position and a configuration of the refrigerating cycle apparatus may vary according to design preference. Thus, a detailed description thereof will be omitted.

Hereinafter, the movable shelf 300 will be described in detail with reference to the accompanying drawings.

Figure 4:
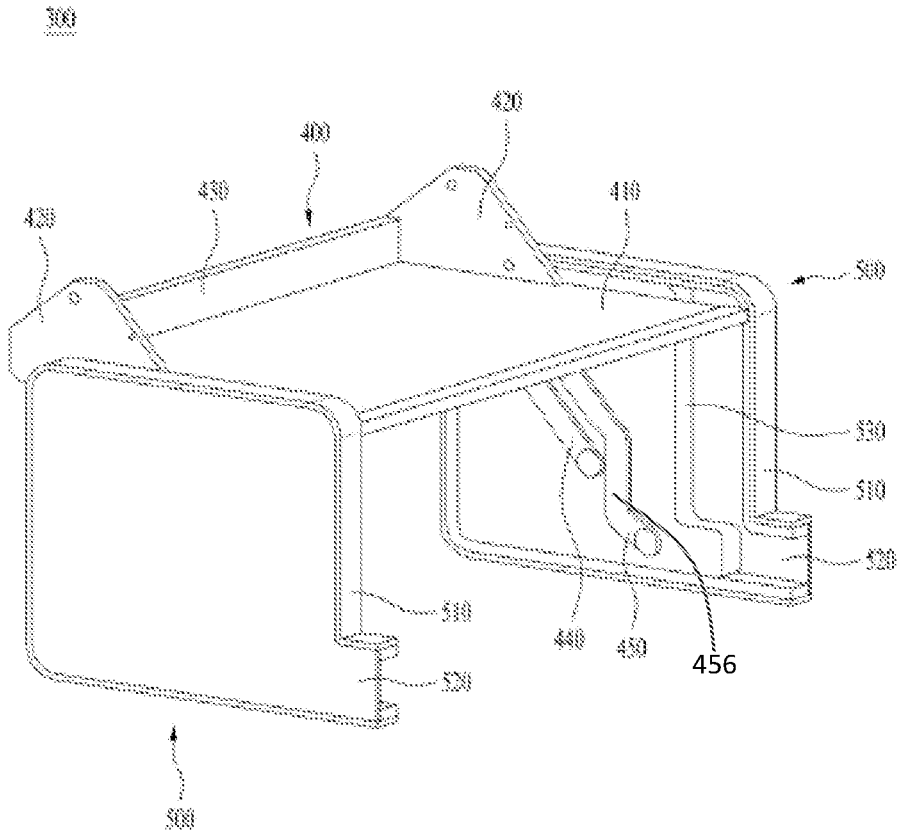
FIG. 4 is a front view showing an installed state of a movable shelf of a refrigerator according to an embodiment of the present disclosure.
Figure 5:
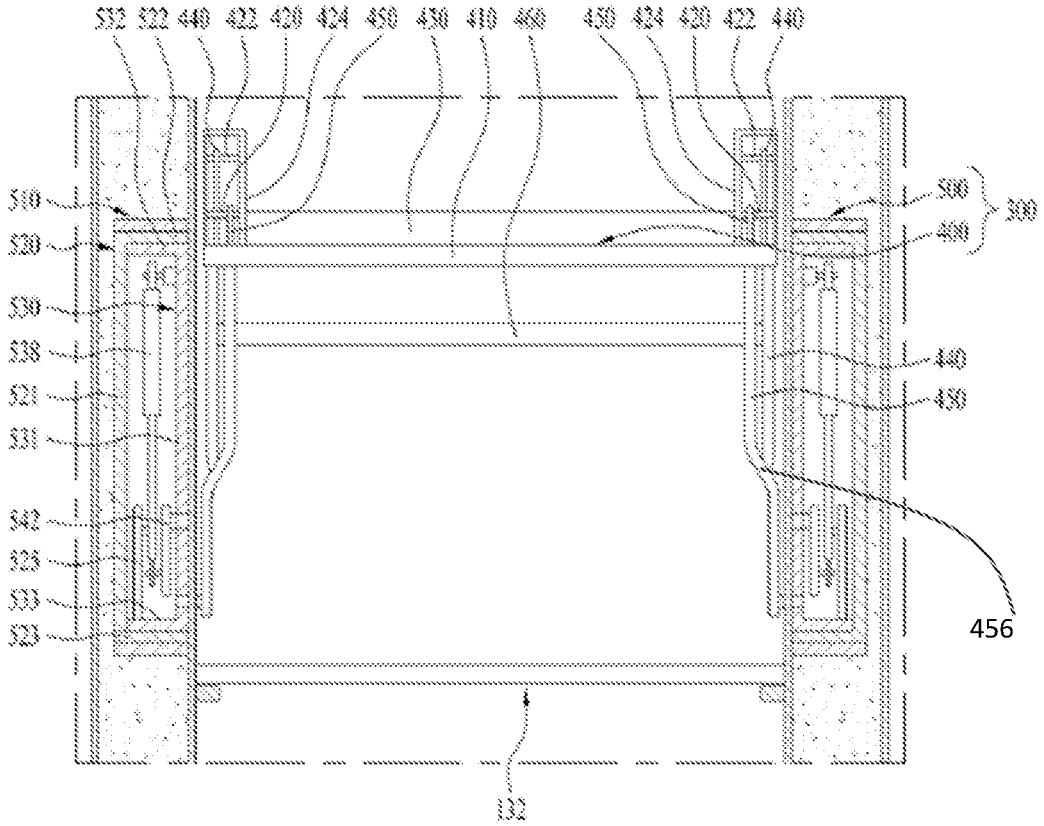
FIG. 5 is a perspective view of a movable shelf of a refrigerator according to an embodiment of the present disclosure.
Figure 6:
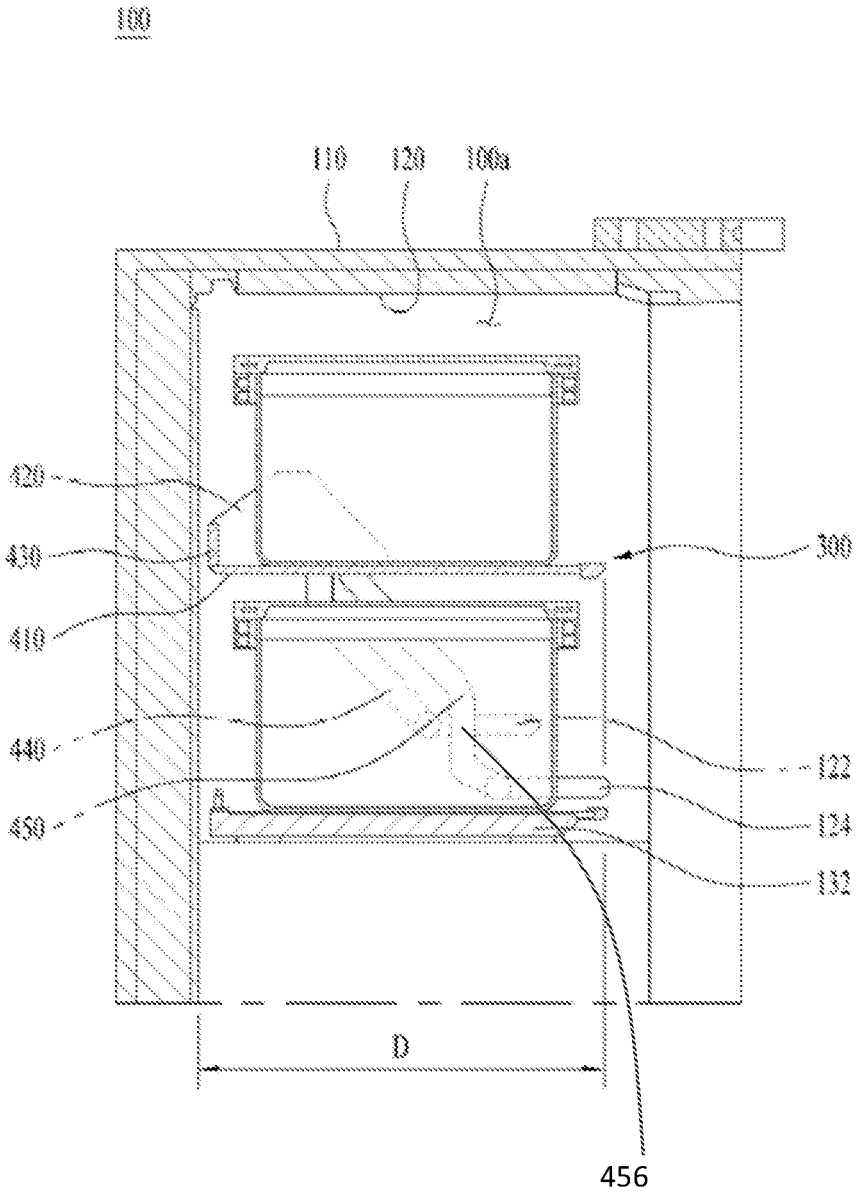
FIG. 6 is a side elevation view showing an initial state of a movable shelf according to an embodiment of the present disclosure.
Figure 7:
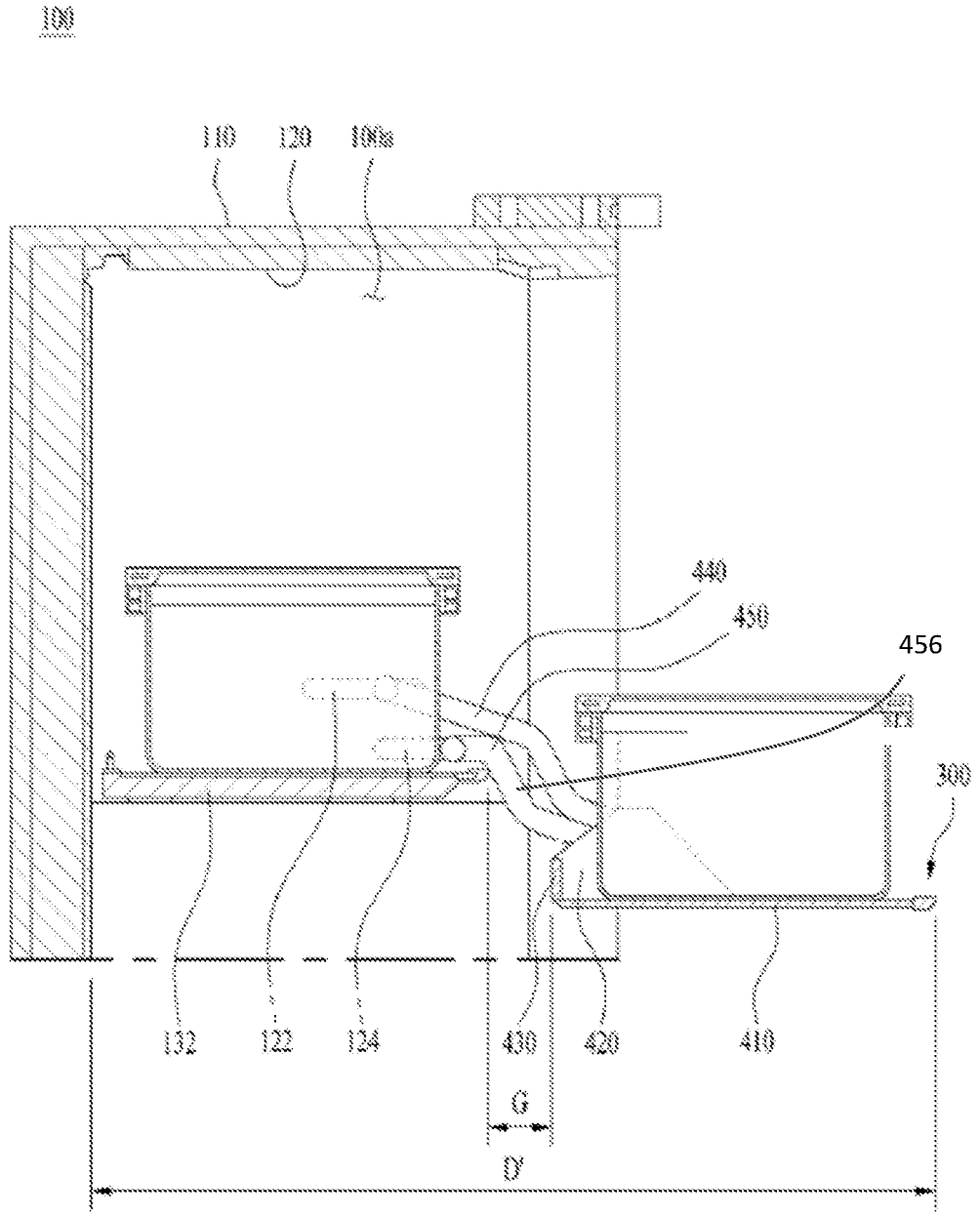
FIG. 7 is a side elevation view showing an extended state of a movable shelf according to an embodiment of the present disclosure.

FIG. 4 is a front view showing an installed state of a movable shelf of a refrigerator according to an embodiment of the present disclosure. FIG. 5 is a perspective view of a movable shelf of a refrigerator according to an embodiment of the present disclosure. FIG. 6 is a side elevation view showing an initial state of a movable shelf according to an embodiment of the present disclosure. FIG. 7 is a side elevation view showing an extended state of a movable shelf according to an embodiment of the present disclosure.

As shown in exemplary FIGS. 4 and 5, the movable shelf assembly 300 may include a movable shelf 400 that is disposed at a higher level in the first storage space 100*a* than another shelf 132 that is disposed at a lower level in the first storage space 100*a* (relative to the movable shelf 400), and is configured to extend and descend to a position in front of shelf 132. The movable shelf assembly 300 may further include drivers 500 that are each disposed respectively at both sides of the first storage compartment 100 (opposite sides) to enable a horizontal movement and a pivoting motion of the movable shelf 400.

The movable shelf 400 is pivotally supported by both of a first link 440 and a second link 450 connected to each of both the drivers 500 arranged on opposite sides of the first storage space 100*a* respectively. For example, when the first link 440 and the second link 450 pivot upwards into the first storage space 100*a*, the movable shelf 400 is configured to retract into an upper portion of the first storage space 100*a* such that the food or container loaded on the movable shelf 400 is retracted into the first storage space 100*a* and stored therein. When the first link 440 and the second link 450 are forwardly pivoted outwardly of the first storage space 100*a*, the movable shelf 400 is configured to extend from the upper portion of the first storage space 100*a* out of the first storage space 100*a* such that the food or container loaded on the movable shelf 400 is extended out of the first storage space 100*a*.

The driver 500 is located on each of both sides of the movable shelf 400 (opposite sides) and supports the pivoting of the first link 440 and the second link 450 connected to the movable shelf 400. In this embodiment, for example, the driver 500 is disposed in a space between the outer casing 110 and the inner casing 120 forming the first storage compartment 100. Both drivers 500 may be arranged in a symmetrical manner on both sides (opposite sides) of the first storage compartment 100 respectively.

In this embodiment, the movable shelf 400 may include a body 410 having a width D (see FIG. 6) by a predetermined dimension smaller than a depth-directional width of the first storage space 100*a* and being movable forwardly of the first storage space 100*a* and vertically. The movable shelf 400 may additionally include a support 420 disposed at a rear portion of each of both sides of the body 410 and coupled to the first link 440 and a second link 450. The movable shelf 400 may include a stopper 430 disposed at a rear of the body 410 that is provided to connect the both supports 420 with each other to prevent the food and the container loaded on the body 410 from falling down rearwardly of the body 410.

In this embodiment, the support 420 extends vertically from the rear portion of each of both sides of the body 410. As shown in FIG. 5, the support 420 may include a first hinge 422 to which the first link 440 is connected and a second hinge 423 to which the second link 450 is connected.

In one example, the arrangement of the first hinge 422 and the second hinge 423 may vary depending on an initial position and a pivoting position of the body 410 supported by the first link 440 and the second link 450. In this embodiment, the first hinge 422 is preferably disposed at a position higher than the second hinge 423 and in rear of the second hinge 423 such that the body 410 pivots vertically.

Figure 8:
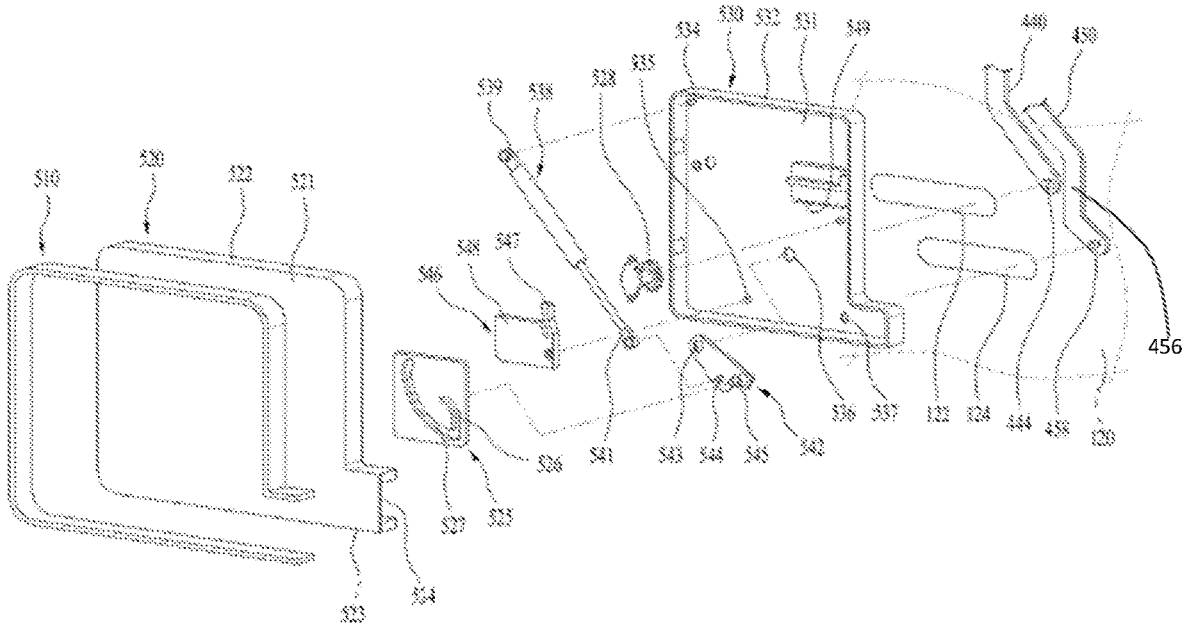
FIG. 8 is an exploded perspective view showing a movable shelf driver of a refrigerator according to an embodiment of the present disclosure.

In this embodiment, a first hinge receiving hole (not shown) and a second hinge receiving hole (not shown) for receiving the first hinge 422 and second hinge 423 respectively may be provided at top ends of the first link 440 and second link 450. A connection shaft 444 and a rotation shaft 458 rotatably connected to the driver 500 may be coupled to bottom ends of the first link 440 and the second link 450 respectively (FIG. 8). In this embodiment, the connection shaft 444 coupled to the first link 440 may have a polygonal shape so that free rotation thereof with respect to the driver 500 is limited. It is understood that the shape is not limited to polygonal. The rotation shaft 458 coupled to the second link 450 may be configured to freely rotate with respect to the driver 500.

In one example, the first link 440 and the second link 450 are formed to have the same or substantially the same radius of rotation when they respectively pivot around the first hinge 422 and the second hinge 423 of the support 420 to which the first link 440 and the second link 450 are connected. Therefore, the same horizontal oriented state of the body 410 may be maintained both when the body 410 is stored in the first storage space 100*a* and the body 410 is extended from the first storage space 100*a* (FIG. 6 and FIG. 7).

For example, while the first link 440 and second link 450 have the same radius of rotation, the first link 440 and second link 450 have rotation axes respectively corresponding to the first hinge 422 and second hinge 423 spaced from each other by a predetermined spacing on the support 420 of the body 410. Thus, while the body 410 may be pivoted together with a pivoting motion of the first link 440 and the second link 450, the body 410 may be always horizontally oriented (FIG. 7).

In one example, the driver 500 may support the movable shelf 400 and the first link 440 and the second link 450 connected to the movable shelf 400 to move in the horizontal direction in the first storage space and at the same time to (simultaneously) pivot forwardly of the first storage space 100*a*.

Each driver 500 may include a movable housing 530 to pivotally support the first link 440 and the second link 450 forwardly of the first storage space 100*a*, and a fixed housing 520 disposed outside the movable housing 530 and supporting the movable housing 530 so as to be movable in a horizontal direction in rearward and forward directions in the first storage space 100*a*, and a fixing frame 510 disposed outside the fixed housing 520 to fixedly maintain the fixed housing 520 in a space between the outer casing 110 and the inner casing 120. The driver 500 will be described in detail with reference to the separate drawings below.

In one example, lengths of the first link 440 and the second link 450 may be set such that the movable shelf 400 pivotally supported by the first link 440 and the second link 450 has a radius of rotation greater than a width D of the fixed shelf 132 located below the movable shelf assembly 300 and thus such that the movable shelf 400 of the movable shelf assembly 300 pivots into a position in front of the fixed shelf 132.

However, as described above, it may be problematic when the lengths of the first link 440 and the second link 450 are set such that the movable shelf 400 of the movable shelf assembly 300 pivots into a position in front of the fixed shelf 132 because a gap between the movable shelf assembly 300 and the fixed shelf 132 may be relatively larger. Accordingly, the lengths of the first link 440 and the second link 450 may be relatively smaller, and, at the same time, the pivoting positions of the first link 440 and the second link 450 coupled to the driver 500 of the movable shelf assembly 300 may vary. This pivot position variation of the first link 440 and the second link 450 will be described in detail in the description of the driver 500.

Further, at least one of the first link 440 and the second link 450 may include a bent portion to prevent interference with each other during the pivot movement of the movable shelf 400. In this embodiment, for example, a bent portion 456 of the second link 450 is bent inwardly of the first storage space 100*a* to prevent interference between the second link 450 and the first link 440. Not limited thereto.

Further, a reinforcing bar 460 may connect both first links 440 coupled to both sides of the body 410 respectively to reduce left and right directional vibrations of the body 410 when the body 410 pivots. When the body 410 pivots, for example, the reinforcing bar 460 connected between both first links 440 may prevent the first links 440 from moving due to vibration.

In one example, a first slot 122 and a second slot 124 may be provided in each of both sides of the inner casing 120 forming the first storage space 100*a* such that the shafts coupled to the first link 440 and the second link 450 connecting each driver 500 to the movable shelf 400 may move in and along the first slot 122 and second slot 124 respectively horizontally when the movable shelf 400 extends and retract from and into the first storage space 100*a* (FIG. 8).

In this connection, the first slot 122 and the second slot 124 may be disposed in each of both side walls of the inner casing 120 forming the first storage space 100*a* in a horizontal elongate manner such that the shafts coupled to the first link 440 and the second link 450 connecting each driver 500 to the movable shelf 400 may move horizontally in the first storage space 100*a* (FIG. 8) according to the operation of the driver 500.

Hereinafter, the driver of the movable shelf assembly will be described in detail with reference to the accompanying drawings.

FIG. 8 is an exploded perspective view showing a movable shelf driver of a refrigerator according to an embodiment of the present disclosure.

As described above, each driver 500 may be inserted and disposed symmetrically in the space between the outer casing 110 and the inner casing 120 forming the first storage compartment 100. Therefore, for purposes of convenience, only one of the drivers 500 will be described in detail. Detailed description of the other driver 500 is omitted.

As shown in FIG. 8, the driver 500 is fixedly disposed into the space between the outer casing 110 and the inner casing 120 of the first storage compartment 100. As described above, each driver 500 includes the fixing frame 510, the fixed housing 520, and the movable housing 530. The first link 440 and the second link 450 are pivotally supported on the movable housing 530.

The fixed housing 520 is formed having a casing shape in which a face thereof facing the movable shelf 400 is opened so that the movable housing 530 is movably inserted therein. The fixed housing 520 has an outer wall portion 521 forming one side wall and a communication portion 524 extending from a front lower portion of the outer wall portion 521 and communicating with the outside. A top and a bottom of an inner face of the fixed housing 520 may define an upper guide 522 and a lower guide 523 being in contact with a top face and a bottom face of the movable housing 530 respectively to guide the movement of the movable housing 530.

In one example, the communication portion 524 may discharge air moving in the direction in which the movable housing 530 movably inserted into the fixed housing 520 moves. A portion of the movable housing 530 is inserted into the communication portion 524 to serve to fix the movable housing 530 thereto.

The movable housing 530 is formed having a casing shape in which a face thereof facing the fixed housing 520 is opened and is inserted into the casing shaped fixed housing 520 so as to be movable along the inner upper and lower faces of the fixed housing 520.

The movable housing 530 has an inner wall portion 531 forming the other side wall. An outer top face and bottom face of the inner wall portion 531 may define an upper contact face 532 and a lower contact face 533 respectively movable while being in contact with the inner top face and bottom face of the fixed housing 520.

The fixing frame 510 surrounds the outer circumferential surface of the fixed housing 520 to fixedly maintain the fixed housing 520 in the space between the outer casing 110 and the inner casing 120 and to reinforce the strength of the fixed housing 520.

The fixing frame 510 may be made of a metal material and have a predetermined length. The fixing frame 510 is not limited to a metal material. However, when the strength of the fixed housing 520 itself is guaranteed, the driver 500 may be installed using only the fixed housing 520 without using the fixing frame 510.

In one example, a rack 549 and a rotor damper 528 may be disposed between the fixed housing 520 and the movable housing 530 to prevent sudden movement or jerk of the movable housing 530. The rotor damper 528 may be fixedly disposed inside the fixed housing 520 and the rack 549 may be integrally formed with the inner wall portion 531 of the movable housing 530 and may be disposed inside the movable housing 530.

In this embodiment, the rack 549 has a plurality of gear teeth corresponding to the travel distance of the movable housing 530. The rotor damper 528 has a gear teeth that are configured to engage with the gear teeth of the rack 549. Therefore, as the movable housing 530 moves, the gear of the damper mesh and rotate with the gear teeth of the rack 549 and thus a shaft of the rotor damper 528 decelerates the rotation of the gear thereof to reduce the moving speed of the movable housing 530.

In one example, a lower front portion of the movable housing 530 has a pivot hole 537 pivotally fastened to the rotation shaft 458 of the second link 450. A rear upper portion of pivot hole 537 has a through-hole 536 through which the connection shaft 444 of the first link 440 is inserted or penetrated.

In this connection, the rotation shaft 458 of the second link 450 inserted and fastened to the pivot hole 537 is coupled to the driver to freely rotate according to the pivoting of the second link 450. The connection shaft 444 of the first link 440 through the through-hole 536 is coupled to the linear and pivoting motion switch 542 which will be described later while a rotation thereof is limited.

Further, inside the movable housing 530, the linear and pivoting motion switch 542 is disposed. The switch 542 is connected to the connection shaft 444 of the first link 440 and configured to rotate together with the first shaft 444 along the pivoting of the first link 440 using the rotation shaft as the first link 440. Inside the movable housing 530, a cylinder damper 538 is disposed. One end of the cylinder damper 538 is pivotably connected to the inner face of the movable housing 530 while the other end thereof is connected to the linear and pivoting motion switch 542 to limit the rotational speed of the linear and pivoting motion switch 542. A linear and pivoting motion guide 525 is placed in the fixed housing 520 in a corresponding manner to the linear and pivoting motion switch 542 to guide the motion of the linear and pivoting motion switch 542 during the horizontal movement of the movable housing 530 and the pivoting motion of the first link 440. An elastic support 546 may maintain the state in which the linear and pivoting motion switch 542 has been shifted with a predetermined elastic force.

In this embodiment, the linear and pivoting motion switch 542 may be formed having a generally triangular plate shape (FIG. 8). The shape is not limited thereto. A first link coupling hole 543 for receiving the connection shaft of the first link 440 may be provided at one corner area of the motion switch 542. A damper connection shaft 544 connected to one end of the cylinder damper 538 may be disposed at another corner area of the motion switch 542. A slidable protrusion 545 inserted into the linear and pivoting motion guide 525 and guided thereby may be disposed at still another corner area of the motion switch 542.

In one example, the first link coupling hole 543 may be formed having a polygonal shape corresponding to the shape of the connection shaft 444 of the first link 440 in order to prevent the free pivoting of the first link 440 and to improve the coupling force therebetween. The shape is not limited thereto.

One end of the cylinder damper 538 may be pivotally connected to a damper fixing boss 534 disposed at a rear top portion of the movable housing 530. The other end of the cylinder damper 538 may be connected to the damper connection shaft 544 of the linear and pivoting motion switch 542. Thus, the cylinder damper 538 may expand and contract in accordance with the movement of the linear and pivoting motion switch 542 to control the rotation speed of the linear and pivoting motion switch 542.

The linear and pivoting motion guide 525 may be fixed to the fixed housing 520. When the movable housing 530 moves inside the fixed housing 520, the guide 525 is configured to guide and limit the motion of the first link 440. As shown, the linear and pivoting motion guide 525 may have a first curved slot 526 and a second curved slot 527 into and along which the slidable protrusion of the linear and pivoting motion switch 542 is inserted and moved.

In this embodiment, the first curved slot 526 is configured to guide movement of the slidable protrusion 545 of the linear and pivoting motion switch 542 when the movable housing 530 moves horizontally relative to the fixed housing 520. That is, when the movable housing is moved horizontally with respect to the fixed housing, the sliding protrusion of the switch moves along the first curved slot, and thus the cylinder damper 538 connected to the linear and pivoting motion switch 542 contracts.

The second curved slot 527 may be configured to guide the slidable protrusion 545 of the linear and pivoting motion switch 542 connected to the first link 440 when the movable shelf 400 pivots forwardly of the first storage space 100*a* and is extended therefrom while the movable housing has moved relative to the fixed housing.

That is, the linear and pivoting motion switch 542 moves as the first link 440 pivots together with the pivoting motion the movable shelf 400. Then, the linear and pivoting motion switch 542 moves as the slidable protrusion 545 of the linear and pivoting motion switch 542 moves along the second curved slot 527.

At this time, the linear and pivoting motion switch 542 is connected to the cylinder damper 538. Thus, as the linear and pivoting motion switch 542 rotates, the cylinder damper 538 contracts to slow the movement speed of the linear and pivoting motion switch 542. Thus, the pivoting speeds of the first link 440 connected to the linear and pivoting motion switch 542 and the movable shelf 400 connected to the first link 440 may be reduced.

In one example, an elastic support 546 may be fixedly coupled to a support fixing boss 535 disposed on a rear portion of the inner face of the movable housing 530. This elastic support 546 may have a supporting protrusion 547 adjacent to the rotation radius of the linear and pivoting motion switch 542 and corresponding to the rotation radius of the linear and pivoting motion switch 542, and an elastic groove 548 adjacent to the supporting protrusion 547 to allow the supporting protrusion 547 to have elastic force.

When the linear and pivoting motion switch 542 is fully rotated, e.g., when the movable shelf 400 is fully extended, the elastic support 546 operates to limit the movement of the linear and pivoting motion switch 542 by the supporting protrusion 547 applying a predetermined elastic force to an end of the linear and pivoting motion switch 542. Therefore, the elastic fixing of the linear and pivoting motion switch 542 by the elastic support 546 may limit the movement of the first link 440 and the movable shelf 400 connected to the linear and pivoting motion switch 542.

Hereinafter, an operation of the movable shelf assembly in accordance with an embodiment of the present disclosure will be described in detail with reference to the accompanying drawings.

Figure 9:
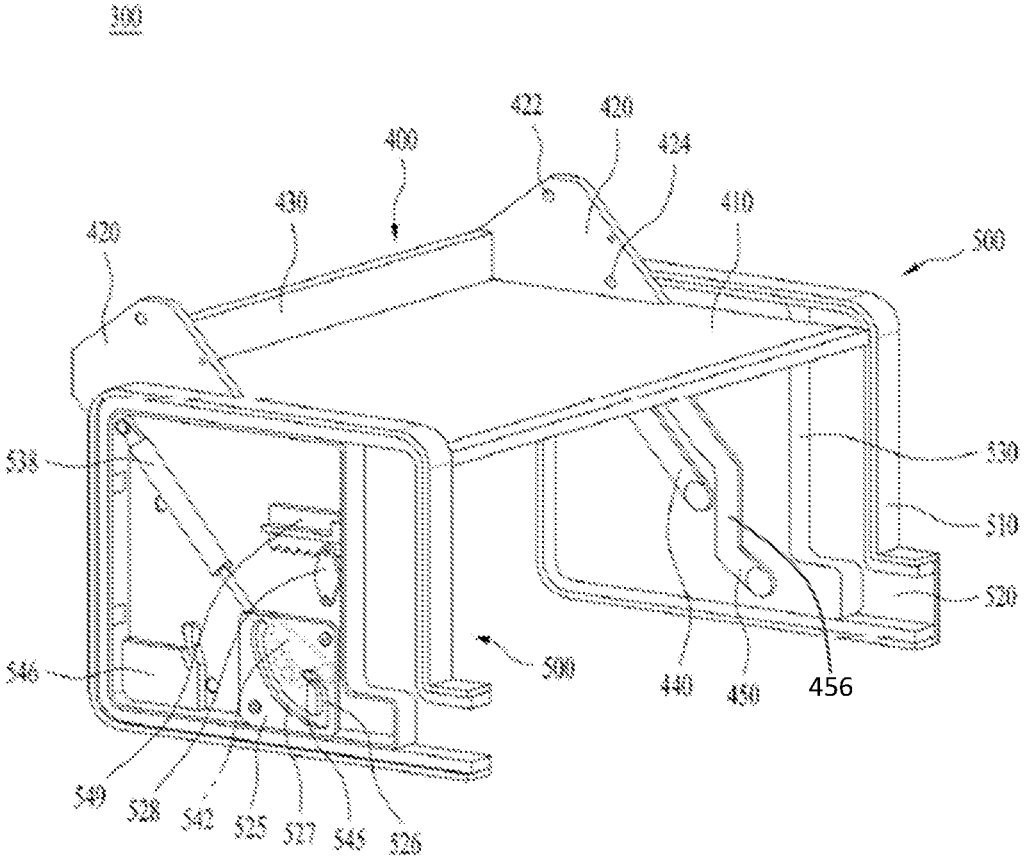
FIG. 9 is a perspective view showing an initial state of a movable shelf according to an embodiment of the present disclosure.
Figure 10:
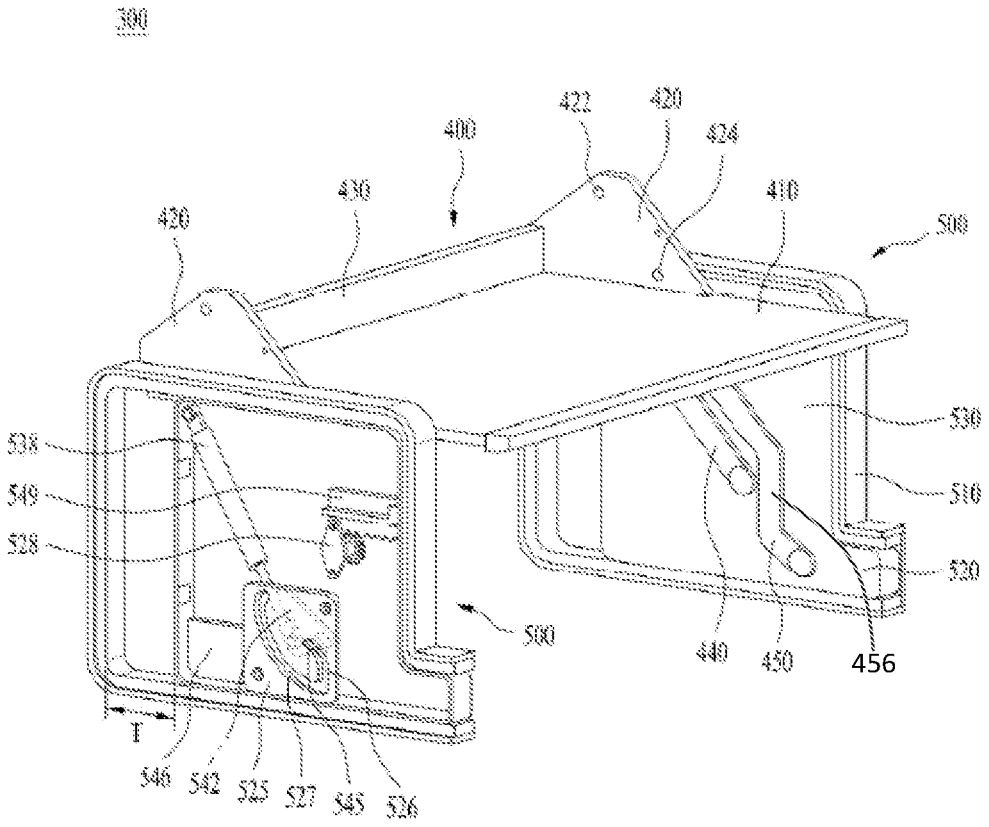
FIG. 10 is a perspective view of a slidably extended state of a movable shelf according to an embodiment of the present disclosure.
Figure 11:
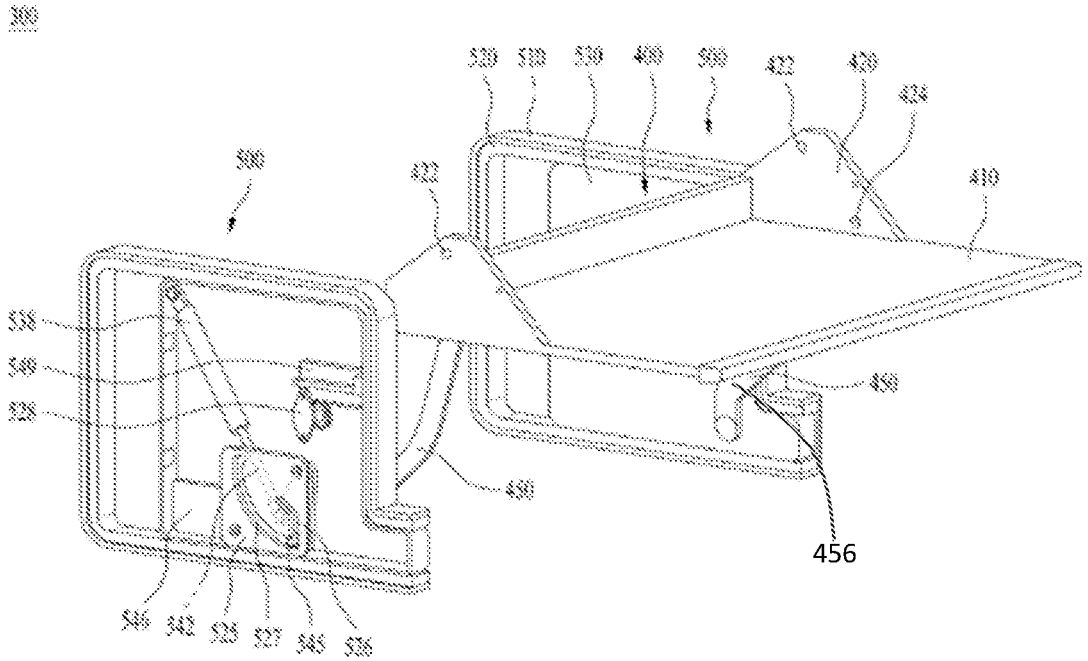
FIG. 11 is a perspective view showing a descending process of a movable shelf according to an embodiment of the present disclosure.
Figure 12:
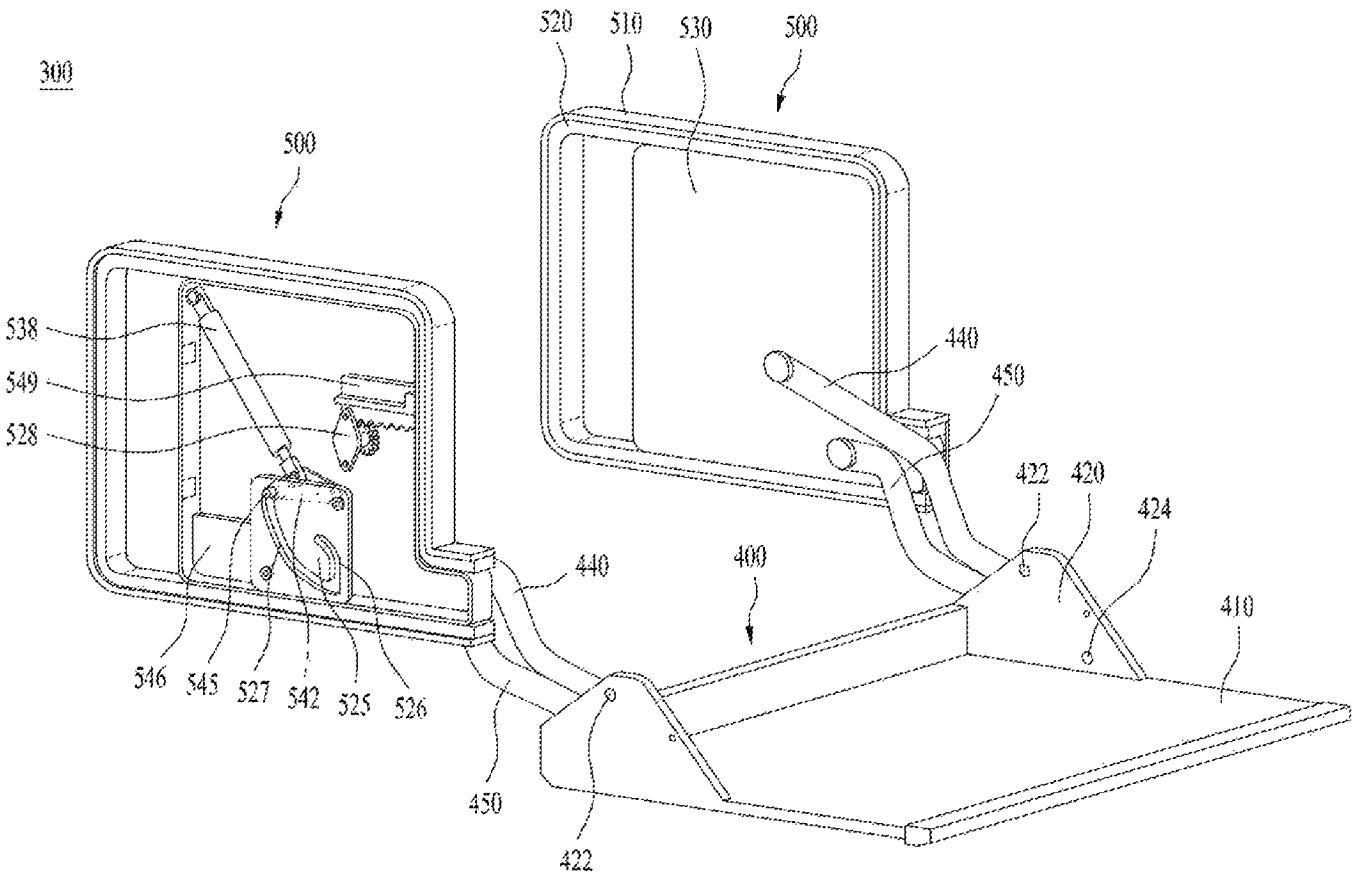
FIG. 12 is a perspective view showing a descended state of a movable shelf according to an embodiment of the present disclosure.

FIG. 9 is a perspective view showing an initial state of the refrigerator movable shelf assembly according to an embodiment of the present disclosure. FIG. 10 is a perspective view showing the sliding extended state of the refrigerator movable shelf assembly according to an embodiment of the present disclosure. FIG. 11 is a perspective view showing the descending process of the refrigerator movable shelf assembly according to an embodiment of the present disclosure. FIG. 12 is a perspective view showing the descended state of the refrigerator movable shelf assembly according to an embodiment of the present disclosure.

In one example, in explaining the operation of the movable shelf assembly 300, to facilitate the operation of the driver 500 of the movable shelf assembly 300, a portion of the outer wall portion of the fixed housing 520 of the driver 500 shown in FIG. 9 to FIG. 12 is omitted. However, the shape of the fixed housing 520 is the same as described above. Thus, the following description is based on the description of the driver 500 described above.

As shown in exemplary FIG. 9, the initial position of the movable shelf 400 is provided in a fully retracted state into the first storage space 100*a*. At this time, the movable housing 530 is positioned at (pushed to) the rear face of the fixed housing 520.

In this embodiment, the rotor damper 528 of the fixed housing 520 is located at a top end of the rack 549 of the movable housing 530. The slidable protrusion 545 of the linear and pivoting motion switch 542 remains as supported at a top end of the first curved slot 526 of the linear and pivoting motion guide 525.

Next, as shown in exemplary FIG. 10, the movable shelf 400 is extended outward from the first storage space 100*a*. This occurs when the user pulls the body 410 of the movable shelf 400 outward to extend the movable shelf 400 from the first storage space 100*a*.

Thus, the movable housing 530 moves by a predetermined distance horizontally forwardly of the first storage space 100*a* with respect to the fixed housing 520. As shown, at this time, the first link 440 and the second link 450 supporting the body 410 of the movable shelf 400 are not pivoted. The movable shelf 400, the first link 440, the second link 450 and the movable housing 530 may be moved horizontally and forwardly of the first storage space 100*a*.

Here, the movable housing 530 moving forwardly of the fixed housing 520 may be controlled by the rotor damper 528. That is, the rack 549 moving together with the movable housing 530 is decelerated by the rotor damper 528 fixed to the fixed housing 520. Thus, the moving speed of the first link 440, second link 450 and movable shelf 400 connected to the movable housing 530 may be reduced.

Here, when the movable housing 530 is moved relative to the fixed housing 520, the slidable protrusion 545 of the linear and pivoting motion switch 542 inserted into the first curved slot 526 of the linear and pivoting motion guide 525 moves along the first curved slot 526 to the second curved slot 527.

Next, as shown in FIG. 11, when the user further pulls and extends the movable shelf 400, the first link 440 and the second link 450 connected to the movable shelf 400 pivot about the connection shaft 444 and the rotation shaft 458 connected to the driver respectively.

Here, the second link 450 pivotally coupled to the driver 500 is freely pivoted according to the pivoting motion of the movable shelf 400, while the motion of the first link 440 allows the movement of the linear and pivoting motion switch 542 to which the first link 440 is connected.

As the first link 440 pivots, the slidable protrusion 545 of the linear and pivoting motion switch 542 moves from the first curved slot 526 to the second curved slot 527 to guide the movement of the linear and pivoting motion switch 542.

As the linear and pivoting motion switch 542 moves, the cylinder damper 538 connected to the linear and pivoting motion switch 542 contracts such that the movement speed of the linear and pivoting motion switch 542 is reduced. Therefore, the pivoting speed of the first link 440 connected to the linear and pivoting motion switch 542 is decelerated.

In one example, when the movable shelf 400 is fully extended to a front position of the first storage space 100*a*, as shown in exemplary FIG. 12, the slidable protrusion 545 of the linear and pivoting motion switch 542 is moved to a distal end of the second curved slot 527 of the linear and pivoting motion guide 525 and remains in the second curved slot 527. The first link 440 stops as the linear and pivoting motion guide 525 stops.

Further, the end of the linear and pivoting motion switch 542 moving along the second curved slot 527 of the linear and pivoting motion guide 525 may be supported and fixed by a predetermined elastic force from the supporting protrusion 547 of the elastic support 546 disposed in the movable housing 530.

As described above, the movable shelf 400 as extended outwardly of the first storage space 100*a* is no longer pivoted and remains at a fixed state as the pivoting motion of the first link 440 and the second link 450 is stopped.

At this position, the user may load food or other items onto the movable shelf 400 of the movable shelf assembly 300 as the movable shelf 400 is extended outward and forward of the first storage space 100*a*. The user may then pivot the movable shelf 400 back so that it is returned to its initial position as shown in FIG. 8 and stored in the first storage space 100*a*.

In this connection, the process of returning the movable shelf 400 of the movable shelf assembly 300 back from the position outside of and in front of the first storage space 100*a* to the initial position in the first storage space 100*a* may be performed in a reverse order to that of the extending process of the movable shelf assembly 300 as described above. Therefore, a detailed description of the returning process of the movable shelf 400 of the movable shelf assembly 300 will be omitted.

In view of the foregoing, the refrigerator of the present disclosure has an improved shelf structure that is more convenient for a user than the shelf structure in conventional refrigerators.

Further, the shelf structure of the present disclosure is improved to change a vertical level of the shelf at which the user stores or withdraw food on or from the shelf such that the user may store and withdraw food easily on or from the shelf.

Furthermore, according to the refrigerator of the present disclosure, the shelf structure of the refrigerator is improved to change a vertical level of the shelf at which the user stores or withdraw food on or from the shelf to improve the use efficiency of the storage space.

Although preferred embodiments have been depicted and described in detail herein, it will be apparent to those skilled in the relevant art that various modifications, additions, substitutions and the like can be made without departing from the spirit of the disclosure, and these are, therefore, considered to be within the scope of the disclosure, as defined in the following claims

What is claimed is:

1. A refrigerator comprising:

a first storage compartment comprising a first storage space defined therein;

a fixed shelf that is detachably disposed in the first storage space; and a movable shelf assembly disposed in the first storage space, wherein the movable shelf assembly is extendable outward of the first storage space, wherein the movable shelf assembly includes:

a movable shelf movably disposed in the first storage space;

a plurality of links, one end of each of the links being pivotally coupled to each of both sides of the movable shelf; and a driver coupled to the other end of each of the links such that each of the links pivots, wherein the driver is configured to simultaneously guide each of the links forwardly and outwardly of the first storage space and pivot each of the links, wherein the plurality of links includes at least two links configured to allow the movable shelf to pivot while a horizontal orientation of the movable shelf is maintained, wherein a bent portion for preventing interference when the movable shelf moves is formed in at least one of the two links.

2. The refrigerator of claim 1, wherein at least one of the at least two links is driven by the driver.

3. The refrigerator of claim 2, wherein the movable shelf comprises:

a body to accommodate a food item, the body having a first side and a second side; and a first support vertically extending from the first side of the body;

a second support vertically extending from the second side of the body, wherein the at least two links are pivotally coupled to each of the first and second supports, wherein the at least two links are coupled at different positions of each of the first and second supports.

4. The refrigerator of claim 2, wherein the movable shelf assembly further comprises a stopper that extends between the first and second supports, the stopper being configured to prevent the food item accommodated by the body from falling off of the body.

5. The refrigerator of claim 1, wherein the driver includes a first driver and a second driver, the first and second drivers being positioned at each of both sides of the first storage compartment respectively, wherein each of the links is pivotally connected to each of the first and second drivers respectively.

6. The refrigerator of claim 1, wherein the driver comprises:

a fixed housing fixed to the first storage compartment; and a movable housing movably disposed in the fixed housing and configured to move forwardly and backwardly in the storage space.

7. The refrigerator of claim 6, wherein the movable housing comprises a rack having a predetermined length, wherein the fixed housing comprises a rotor damper configured to be engaged with the rack to control a speed of movement of the movable housing.

8. The refrigerator of claim 1, wherein the driver further comprises:

a linear and pivoting motion switch disposed in the movable housing, wherein the linear and pivoting motion switch is coupled to and moves together with one of the plurality of links; and a linear and pivoting motion guide disposed in the fixed housing, wherein the linear and pivoting motion guide is configured to guide the movement of the linear and pivoting motion switch.

9. The refrigerator of claim 8, wherein the linear and pivoting motion switch has a slidable protrusion protruding from one end thereof toward the linear and pivoting motion guide, wherein the linear and pivoting motion guide comprises:

a first curved slot configured to guide movement of the slidable protrusion of the linear and pivoting motion switch when the movable shelf moves in a linear direction; and a second curved slot to guide movement of the slidable protrusion when the movable shelf is pivotally moved.

10. The refrigerator of claim 8, wherein the movable housing comprises an elastic support for pressing and stopping the linear and pivoting motion switch using a predetermined elastic force when the linear and pivoting motion switch moves.

11. The refrigerator of claim 1, wherein the refrigerator further comprises a second storage compartment disposed below the first storage compartment, the second storage compartment comprising a second storage space defined therein, the second storage compartment operating independent of the first storage compartment.

12. The refrigerator of claim 11, wherein the second storage compartment comprises at least one drawer configured to extend outward from the second storage space to open the second storage space.

* * * * *